United States Patent [19]

Perks

[11] 3,961,711

[45] June 8, 1976

[54] OVERHEAD STORAGE APPARATUS

[76] Inventor: Arthur Thomas Perks, 37, The Green, Castle Bromwich, Birmingham B36 9AL, England

[22] Filed: Dec. 26, 1974

[21] Appl. No.: 536,696

Related U.S. Application Data

[63] Continuation of Ser. No. 331,444, Feb. 12, 1973, abandoned.

[52] U.S. Cl. ..... 211/117; 248/322

[51] Int. Cl.[2] ..... A47F 5/08

[58] Field of Search ..... 211/117, 113, 94; 248/320–322, 328, 337, 333; 24/211 P

[56] References Cited

UNITED STATES PATENTS

| | | | |
|---|---|---|---|
| 518,198 | 4/1894 | McCamey | 248/337 |
| 529,628 | 11/1894 | Reilly | 211/117 |
| 675,861 | 6/1901 | Marquart | 211/117 X |
| 695,299 | 3/1902 | Freeland | 24/211 P X |
| 812,396 | 2/1906 | Bewyer | 211/117 X |
| 1,858,595 | 5/1932 | Parker et al. | 211/117 |
| 2,488,582 | 11/1949 | Cinamon | 211/113 |
| 3,335,872 | 8/1967 | Dodich | 211/94 X |

*Primary Examiner*—Ramon S. Britts
*Attorney, Agent, or Firm*—A. Yates Dowell, Jr.

[57] ABSTRACT

An overhead storage apparatus having a vertical main support member of which the upper end can be supported by a ceiling and an article carrying member, and articles carried thereby, is slidable vertically along the main support member into a raised article storing position in which the article carrying member is retained by releasable catch means disposed at the lower ends of the members but above an operator standing on a floor, so that the catch means can be manually released by the operator to enable the article carrying member to slide vertically downwardly into a lowered position rendering the articles accessible to the operator, said lowered position being determined by stop means which can be actuated to enable the article carrying member to be separated from the main support member.

5 Claims, 26 Drawing Figures

OVERHEAD STORAGE APPARATUS

This is a continuation, of application Ser. No. 331,444, filed Feb. 12, 1973, now abandoned.

BACKGROUND OF THE INVENTION

Field of the invention.

This invention relates to overhead storage apparatus for articles to enable articles to be placed into and removed from an overhead storage space whilst leaving a floor area below the apparatus unobstructed by the overhead storage apparatus.

It is an object of the present invention to provide an overhead storage apparatus which is inexpensive to manufacture and is of simple construction and is efficient and reliable in operation.

BRIEF SUMMARY OF THE INVENTION

According to the present invention, in an overhead storage apparatus there is provided a main support member having an attachment means at an upper end whereby said member can be attached to an overhead stationary support, an article carrying member mounted on the main support member so as to be slidable upwardly and downwardly along said main support member, releasable catch means between said two members and biased or otherwise movable into an operative position when the article carrying member is lifted into a raised position to retain said article carrying member in said raised position and said catch means being arranged so as to be capable of being actuated at a position adjacent the lower ends of said members to release the catch means and allow the article carrying member to move downwardly into a lowered position.

BRIEF DESCRIPTION OF THE DRAWINGS.

Various forms of overhead storage apparatus according to the present invention will now be more particularly described by way of example with reference to the accompanying drawings:

Referring to FIG. 1, a horizontal ceiling or the like is indicated at 30 and this ceiling can form part of any premises of any convenient size or alternatively the ceiling may be provided by the top of a fabricated structure supported by suitable uprights 32 which are shown for convenience only as being fairly close together. Secured to the ceiling 30 in any convenient manner are two identical brackets 34 which form overhead stationary supports and each is formed with a horizontal hole which can receive an upper hooked end 36 of a main support member 38. The main support member 38 is formed of metal rod of square cross-sectional shape as shown in FIG. 3, or alternatively said rod may be of circular cross-sectional shape, and affords a substantially vertical straight rod portion 40 which at its lower end is bent upwardly upon itself to afford a transverse abutment lug 42 having a horizontal upper abutment face 44 and said transverse abutment lug 42 also affords a releasable catch means hereinafter to be referred to.

Figure 3:
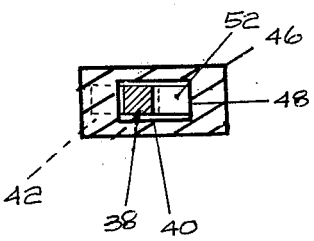
FIG. 3 is a cross-sectional view of FIG. 1 on the lines 3—3 thereof and on an enlarged scale.

The rod portion 40 of the main support member 38 extends through a substantially vertical tubular article carrying member 46 which may be made of a suitable plastics material or may be made of metal and said tubular article supporting member is of elongated rectangular shape in cross-section as shown in FIG. 3 and has an elongated rectangular bore 38 and the width of said bore and the width of the rod portion 40 are such as to enable the article carrying member 46 to have an easy slide-fit engagement with the main support member 38.

At the lower end of the article carrying member 46, one narrower end wall is gapped at 49 to afford a horizontal lower abutment face 50 and the releasable catch means formed by the transverse abutment lug 42 is biased into engagement with said lower abutment face 50 by a limb spring 52 of which an upper end is anchored into a wall of the tubular article carrying member 46 and of which a lower end bears against a side of the rod portion 40 opposite that side of said rod portion on which the transverse abutment lug 42 is provided.

Disposed adjacent the upper end of the article carrying member 46 is a horizontally disposed peg 54 which is mounted in a wall of the tubular article carrying member and projects into the bore thereof so as to be capable of forming stop means and conveniently the peg may be of circular cross-section and may have a push-fit engagement with the wall of the article carrying member or may have a screw-engagement with said wall so that in either case said peg can be intentionally removed when required for a purpose hereinafter to be described.

Figure 2:
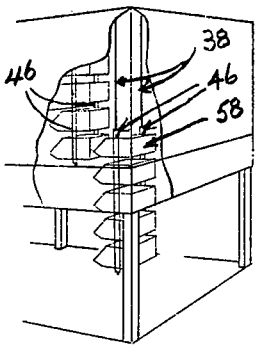
FIG. 2 is a diagrammatic perspective view of a modified form of apparatus in which two article carrying members are rigidly transversely coupled together and are shown in a raised position and a further pair of article carrying members are also rigidly transversely coupled together and are shown in a lowered position.

The article carrying member 46 may be arranged to carry article of any convenient sorts by providing the article carrying member 46 with one or more hooks or eyes 56 by which the articles can be supported or alternatively suitable article containing trays or baskets such as are indicated at 58 in FIG. 2 may be secured to the article carrying member 46 and it should be appreciated that article carrying members 46 will be provided with hooks or eyes or trays or baskets or grids or other means dependent entirely upon the sorts of articles to be stored.

Figure 1:
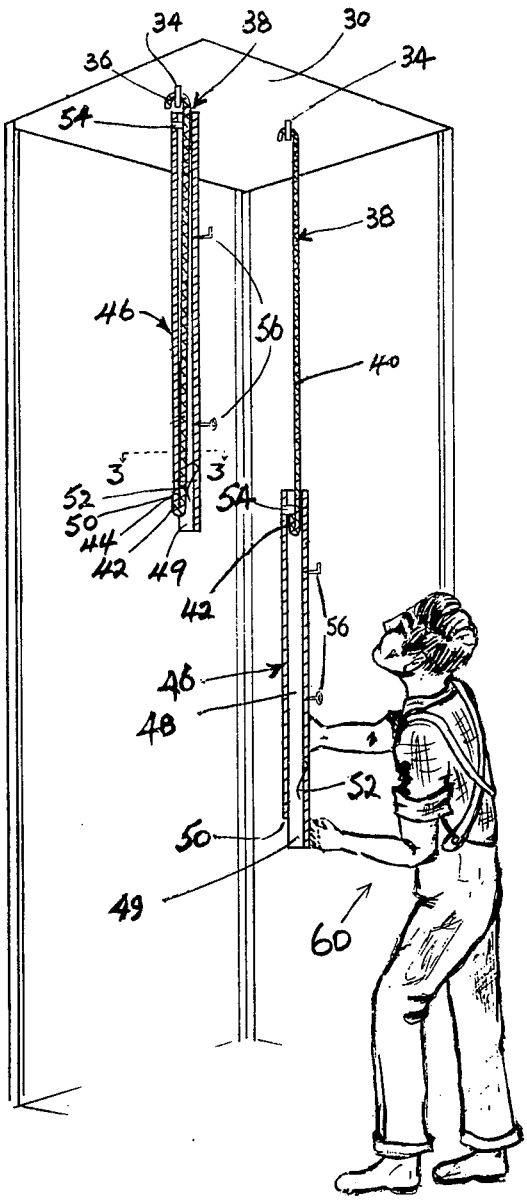
FIG. 1 is a fragmentary perspective sectional view of overhead storage apparatus showing two separate article carrying members of which one is retained in a raised position whilst the other is retained in a lowered position.

In FIG. 1 the article carrying member 46 of the right-hand apparatus is being controlled by an operator 60 and said article carrying member 46 occupies a lowered position in which it is prevented from separation from the main support member 38 by the abutment of the stop peg 54 with the transverse abutment lug 42 and in this lowered position of the article carrying member, articles can be placed on or removed from said article carrying member which is in a convenient position for this purpose. After the articles have been placed on or removed from the article carrying member, the operator lifts the article carrying member 46 so that it slides upwardly along the main support member 38 until the article carrying member 46 achieves a fully raised position as shown in the left-hand apparatus in FIG. 1 whereupon the releasable catch means provided by the transverse abutment lug 42 is biased by the spring 52 into co-operative engagement with the lower abutment face 50 of the article carrying member 46 to releasably retain said article carrying member in its raised position in which any articles carried by said member are stored in an overhead position and thus without restricting floor space below the apparatus.

In the raised position of the article carrying member 46, the releasable catch means 42 is arranged so as to be capable of being actuating by the operator 60 at a position adjacent the lower ends of the main support and article carrying members 38 and 46 respectively so that said releasable catch means are readily accessible to the operator 60 by him reaching upwardly whilst, however, said lower ends are above the normal height of the operator so as not to restrict free movement of the operator below the apparatus.

In order to lower an article carrying member 46 from its raised position fromthe operator 60 merely reaches upwardly and exerts manual pressure on the transverse abutment lug 42 and the wall of the article carrying member opposite the gap 48 so as to release the transverse abutment lug and thus the catch means 42 from the lower end face 50 of the article carrying member against the bias of the spring 52 so that said transverse abutment lug 42 is disposed within the bore 48 of the tubular article carrying member 46 which can then slide gravitationally downwardly along the main support member 38 until the stop peg 54 abuts the upper abutment face 44 of the transverse abutment lug or catch means 42 as shown in the right-hand apparatus in FIG. 1. During the downward sliding movement of the article carrying member 46, the mutual engagement of the two members is such as to prevent rotation of the article carrying member 46 around the main support member 38 about an upright axis.

It should be appreciated that each of the two storage apparatuses illustrated in FIG. 1 comprises a single main support member 38 and a single article carrying member 46 whereas in the modified form shown in FIG. 2, each apparatus comprises a pair of article carrying members 46 which are rigidly transversely coupled together by the article receiving trays or baskets 58 as previously referred to and each pair of article carrying members 46 are slidably mounted on a pair of main supporting members 38 anchored at their upper ends to brackets secured to a ceiling or top (not shown). The main support and article carrying members 38 and 46 illustrated in FIG. 2 are identical with those illustrated in FIG. 1 and in order to lower a pair of article carrying members 46, it is necessary to actuate the two releasable catch means 42 simultaneously and to retain the pair of article carrying members 46 in the raised position it is simply necessary to lift said pair simultaneously whereupon the releasable catch means 42 automatically operate to retain said article carrying members in the raised position which is illustrated by the left-hand apparatus in FIG. 2 whilst the right-hand apparatus shows the lowered position which is retained by co-operation of the stop means 54 with the transverse abutment lugs 42. The two transverse abutment lugs 42 of a pair of main support members may extend forwardly or rearwardly relative to a tray or basket 58 or alternatively may extend inwardly towards each other or outwardly away from each other, whichever is found to be most convenient for manual actuation by the operator.

Figure 4:
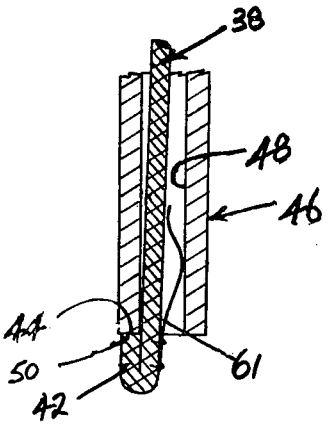
FIG. 4 is a sectional view on an enlarged scale and showing a modified construction of the lower ends of the main support member and the article carrying member when the latter is in the raised position.
Figure 5:
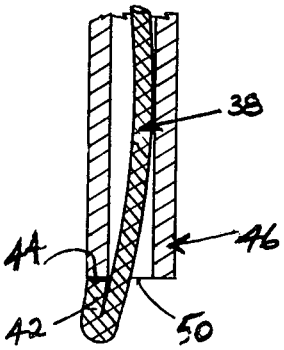
FIG. 5 is a similar view to FIG. 4 but showing a further modified construction.

In the modification shown in FIG. 4, the releasable catch means 42 is biased into co-operative engagement with the lower end face 50 of the article carrying member 46 by means of a limb spring 61 which is secured at its lower end to said main support member 38 and adjacent its upper end bears against a surface of the bore 48 of the rectangular cross-sectioned tubular article carrying member 46. In the modification illustrated in FIG. 5, the main support member 38 is bowed and the inherent resilience of said member causes the releasable catch means 42 to co-operate with the lower end surface 50 of the tubular article carrying member 46 due said bowed main support member 38 bearing against an internal surface of the wall of the tube opposite to that wall affording the lower abutment end surface 50.

Figure 6:
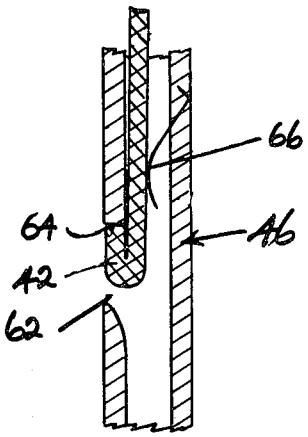
FIG. 6 is a fragmentary sectional view of another modified construction of main support member and article carrying member enabling the article carrying member to be supported in one or more predetermined positions between its raised position and its lowered position.

In the modification shown in FIG. 6, the wall of the tubular article carrying member 46 which affords the lower end abutment face 50 (not shown) and in which the stop peg 54 (not shown) is mounted, is formed with a gap 62 or a plurality of gaps which are spaced apart vertically along said wall so as to provide one or more supplementary abutment faces 64 with which the catch means 42 can co-operate by the biasing pressure exerted by one or more supplementary limb springs 66 positioned adjacent the or each gap 62. With this construction, the article carrying member 46 can be supported in its raised position and in its fully lowered position as previously described with reference to FIG. 1 and can also be supported in a predetermined intermediate position or positions between said raised and fully lowered positions and the catch means is biased automatically into co-operative engagement with the abutment end face 50 or a supplementary abutment face 64 and into co-operative engagement with the stop peg 54 and is manually released from said faces by the operator as previously described.

Figure 7:
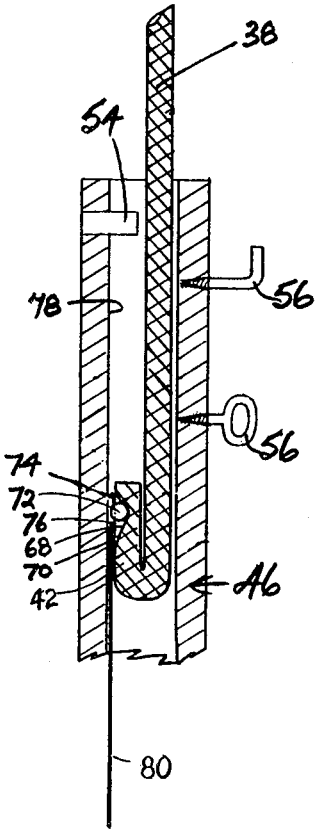
FIG. 7 is a fragmentary sectional view of another modified construction of main support member enabling the article carrying member to be supported in any desired positions along the main support member.

In the modification illustrated in FIG. 7, the transverse abutment lug 42 is formed with a cavity 68 having a lower inclined wall 70 and loosely housed in the cavity is a ball or roller 72 which is retained in the cavity by a retaining plate 74 secured to the lug 42 and said plate has an opening 76 through which the ball or roller 74 projects slightly so as to be capable of frictional contact with a face 78 of the wall of the article carrying member 46 affording the lower end abutment face 50 (not shown) and in which wall the stop peg 54 (not shown) is mounted. The transverse abutment lug or catch means 42 co-operates as described with reference to FIG. 1 with the lower end abutment face 50 and with the stop peg 54 in the raised and lowered positions of the article carrying member 46 and to enable the article carrying member to be retained in any desired position between the raised and lowered positions, a strip-like release key 80, which forms a separate part of the apparatus, can be manually inserted by the operator upwardly between the face 78 and the catch means 42 to lift the ball or roller 74 and allow the tubular article carrying member 46 to be adjusted vertically into the required position along the main support member 38 whereupon the release key 80 is manually withdrawn downwardly out of the tubular article carrying member 46 so that the ball or roller 74 bears against the face 78 whereupon a small downward movement of the article carrying member 46 causes the ball or roller 74 to move downwardly into wedging engagement with the inclined wall 70 so that the article carrying member is frictionally retained in the desired position along the main support member 38. In order to release the article carrying member 46, the release key 80 is manually inserted upwardly to lift the ball or roller 74 out of wedging engagement between the inclined wall 70 and the face 78 of the tubular article carrying member. It should be appreciated that biasing spring 52 (not shown) is provided adjacetnt the lower end of the article carrying member 46.

Figure 8:
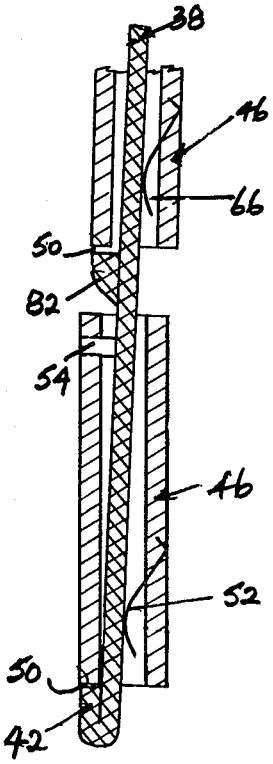
FIG. 8 is a fragmentary sectional view showing another modified construction in which a single main support member can support a plurality of article carrying members arranged in end-to-end relation, FIGS. 9 to 13 inclusive show further modified constructions in which a single main support member has mounted thereon a plurality of article carrying members arranged in end-to-end relation and of which adjacent ends of the article carrying members are or can be positively offset to afford lower abutment faces.
Figure 9:
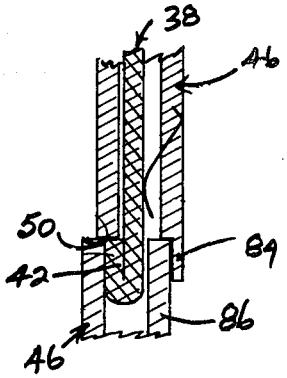

In the modification shown in FIG. 8, a single main support member 38 is provided at its lower end with the transverse abutment or releasable catch means 42 and also, at a position or positions between the upper and lower ends of said main support member, with an intermediate or supplementary transverse abutment member or members or releasable catch means 82 so that the single main support member 38 can support a plurality of article carrying members 46, each of which may be constructed as shown in FIG. 1. The plurality of article carrying members 46 can be passed upwardly along the main support member 38 and the appropriate catch means 42, 82 automatically operate to retain the article carrying members 46 in their appropriate positions and it should be appreciated that each article carrying member is supported independently of the next lower article carrying member because an upper article carrying member does not rest upon the next lower article carrying member. A biasing spring 52 and one or more supplementary biasing springs 66 are provided.

Figure 10:
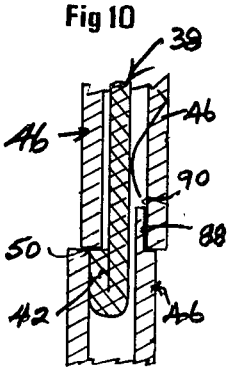
Figure 11:
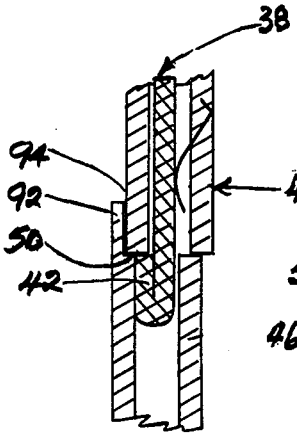
Figure 12:
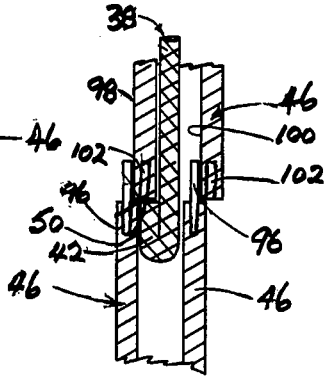
Figure 13:
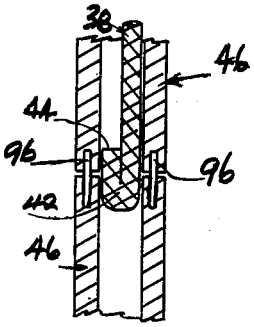

Referring to FIGS. 9 to 13 inclusive, a single main support member 38 is intended to support a plurality of article carrying members 46 arranged in end-to-end relation and the lower and upper ends of adjacent upper and lower article carrying members respectively are positively transversely displaced whereby each article carrying member affords a lower abutment end face 50 into engagement with which the transverse abutment lug or catch means 42 is positively held by the upper end of the lower adjacent article carrying member when said lower member is being extracted or removed downwardly from the main support member 38. For this purpose, in FIG. 9, a downwardly extending spigot 84 of an upper member 46 abuts a side face 86 of the lower article carrying member being removed so that the transverse abutment lug or catch means 42 is positively engaged and retained in engagement with the lower abutment face 50 of the upper article carrying member 46. In FIG. 10 a similar effect is produced by providing an upwardly extending spigot 88 at the upper end of the lower article carrying member 46 and said spigot engages an inner face 90 of the bore of the upper tubular article carrying member 46. In FIG. 11 a similar effect is produced by providing an upwardly extending spigot 92 on the lower article carrying member 46 and said spigot engages an external face 94 of the upper article carrying member 46. In FIG. 12 a similar effect is produced by providing a pair of upwardly extending spigots 96 on the lower article carrying member 46 and said spigots are disposed centrally of the width of each of the narrower walls of the elongated tubular article carrying member and are capable of engaging outside and insde faces 98 and 100 respectively of the upper article carrying member 46 which is formed at its lower end with a pair of sockets 102 which are capable of receiving the spigots 96, as shown in FIG. 13, to enable the upper and lower article carrying members 46 to be aligned in end-to-end relation when it is required to provide what is in effect a single article carrying member from a plurality of shorter article carrying members.

Figure 14:
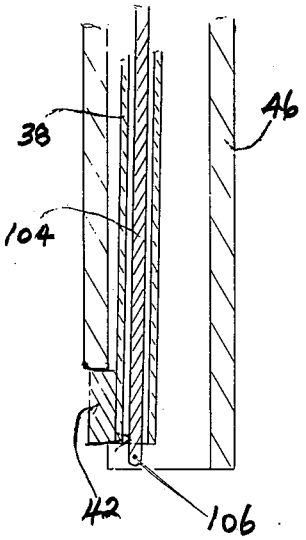
FIG. 14 is a sectional view of another modified construction showing the lower end of a main support member and the lower end of an article carrying member in its raised position and including partial counterbalancing means.
Figure 15:
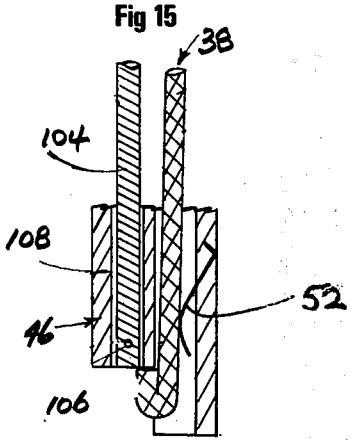
FIG. 15 is a view similar to FIG. 14 but showing a further modified construction including counterbalancing means.

It should be appreciated that whilst the present invention is intended to be used for the storage of relatively light articles, it may be desirable in some instances to counter-balance or partially counter-balance the load supported by the storage apparatus and for this purpose spring counter-balancing means can be employed. Referring to FIG. 14, a metal or rubber tension spring 104 may be disposed in the main support member 38 which is of tubular formation and the lower end of the spring 104 is detachably secured at 106 to the lower end of the article carrying member 46 and the upper end of the spring is secured at a position (not shown) to the upper end of the main support member 38 so that when said article carrying member 46 is not supported by the transverse abutment lug or catch means 42, the tension spring 104 will at least partially support the weight of said article carrying member. A modified form of counter-balancing arrangement is shown in FIG. 15 in which the article carrying member 46 is provided with an additional verticle bore 108 in which the tension spring 104 is disposed and the lower end of said spring is secured at 106 to the article carrying member 46 and the upper end of said spring is secured at a position (not shown) to the upper end of the main support member 38.

Figure 16:
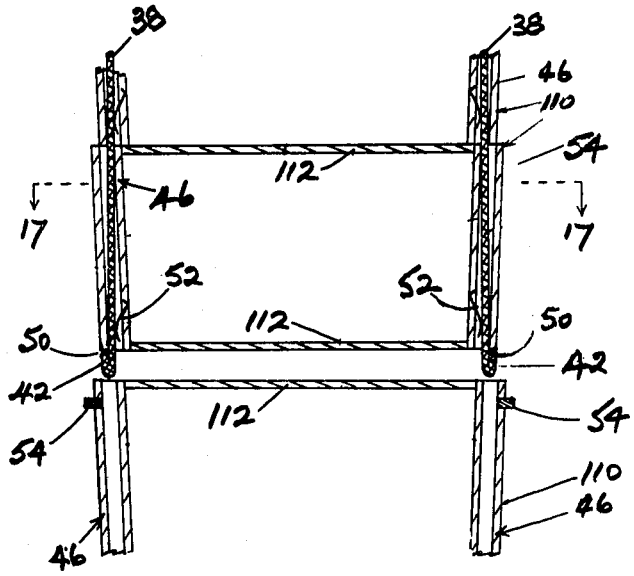
FIG. 16 is a fragmentary sectional front view of an apparatus similar to that illustrated in FIG. 2 and in which two article carrying members are rigidly transversely coupled together and are capable of being supported on two main support members.
Figure 17:
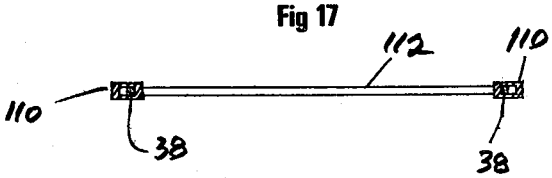
FIG. 17 is a sectional plan view of FIG. 16 on the lines 17—17 thereof.

FIGS. 16 and 17 show an arrangement somewhat similar to that shown in FIG. 2 insofar that a pair of main support members 38 are supported at their upper ends as previously described and are transversely spaced apart. Mounted on the pair of main support members 38 are a plurality of article carrying member units 110 each comprising a pair of substantially upright tubular member 46 which are rigidly connected together by upper and lower cross-bars 112 on which articles can be supported. To ensure that when a lower article carrying member unit 110 is removed downwardly from the lower end of the main support members 38, the adjacent upper article carrying member unit will be supported by the transverse abutment lugs or catch means 42 of the main support members 38, the two tubes 46 of an article carrying unit 110 are toed-inwardly towards each other at their lower ends as shown in FIG. 16 so that the lower abutment faces 50 thereof can be automatically engaged by the spring biased catch means 42 when these are outwardly disposed away from each other as shown in FIG. 16. It should be appreciated that to remove the lowermost article carrying member unit 110, it is necessary to partially withdraw the stop pegs 54 as shown in the lowermost unit in FIG. 16. In a construction in which it is more convenient for the transverse abutment lugs or catch means 42 to be disposed inwardly towards each other, the tubular members 46 of the article carrying member units 110 would be toed-inwardly at their upper ends.

Figure 18:
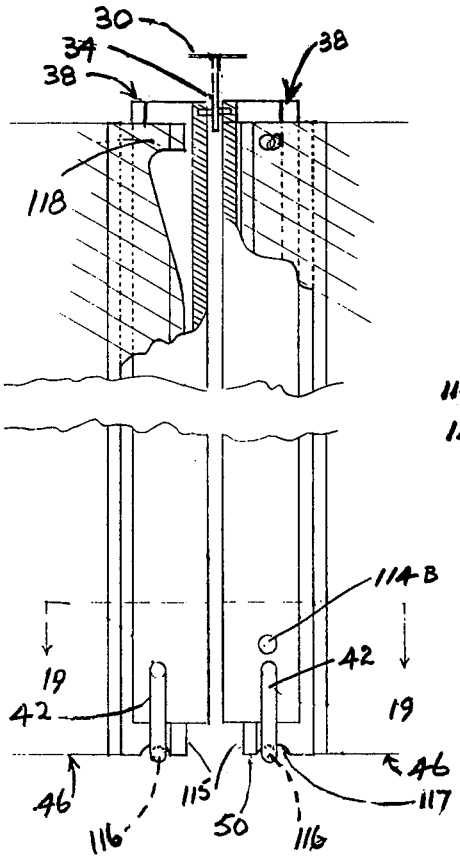
FIG. 18 is a fragmentary view of two main support members each provided with a vertical groove to receive an article carrying member.
Figure 20:
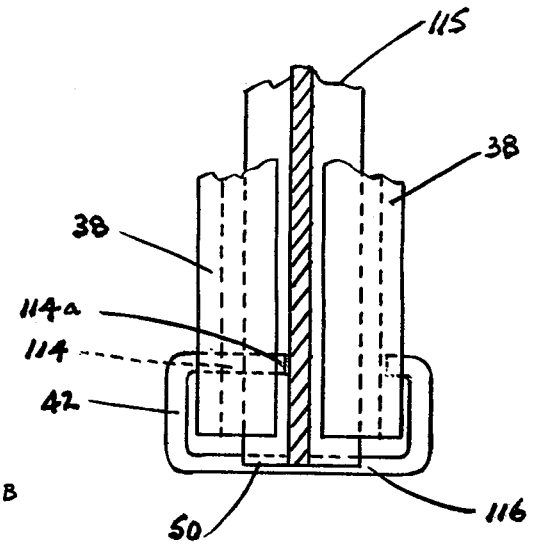
FIG. 20 is a sectional side view of a part of FIG. 18 on the lines 20—20 thereof.
Figure 19:
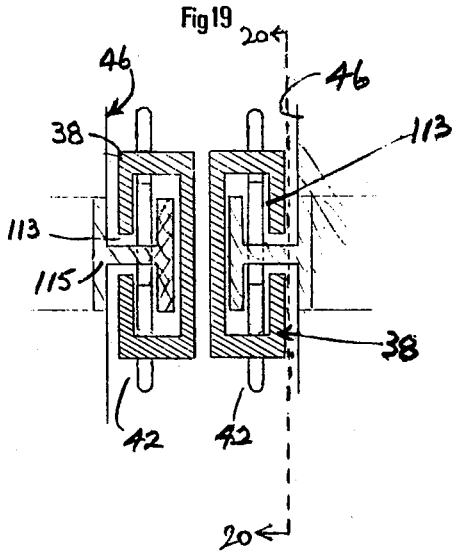
FIG. 19 is a sectional plan view of FIG. 18 on the lines 19—19 thereof.

Referring to FIGS. 18 to 20 inclusive, two main support members 38 are secured to a ceiling or top 30 by a bracket 34 and each main support member is of somewhat C-shaped formation in cross-section, as shown in FIG. 19, to afford a vertical T-groove 113 and the two members 38 are disposed back-to-back. Pivotally mounted on each main support member 38 adjacent the lower end thereof and about a horizontal axis is a catch means 42 which is substantially C-shape as shown in FIG. 20 and the spaced apart ends from pivot trunnions 114 and said catch means 42 is gravitationally biased into an operative vertical position as shown in FIG. 18 in which a lower cross-bar 116 is disposed below a groove 113.

Article carrying members 46 may be in any convenient form suitable for carrying articles and each includes a vertical rib 115 which is of complementary T-shape to a groove 113 and slidably engages said groove and said rib conveniently extends for the full height of the article carrying member so that said member is adequately supported by the engagement of the T-shaped rib 115 and groove 113. In order to engage an article carrying member 46 with a main support member 38 the appropriate catch means 42 is manually pivoted so that its cross-bar 116 is disposed out of vertical alignment with a groove 113 whereupon the upper end of a rib 115 of the article carrying member can be inserted into the lower end of the groove and pushed upwardly by the operator until a lower abutment end face 50 passes slightly above the cross-bar 116 whereupon the catch means gravitationally automatically swings into a vertical operative position below said end face 50 to engage a notch 117 in said end face and retain the article carrying member in its raised position in the main support member 38 as shown in FIG. 18. To lower the article carrying member 46, the pivoted catch 42 is manually pivoted into an inoperative position in which the cross-bar 116 is freed from the lower end abutment face 50 whereupon the article carrying member can be lowered into a lowered position. Two different stop means are shown in FIG. 18 for retaining the two article carrying members 46 in the lowered positions. The left-hand member 46 is automatically retained in the lowered position by the catch means 42 which gravitationally swings from an inclined inoperative position into a vertical operative position in which the cross-bar 116 engages a stop means recess 118 and adjacent an upper end of the rib 115. The article carrying member 46 can be completely removed from the main support member 38 by manually pivoting the catch means so that the cross-bar 116 thereof is disengaged from the recess 118 in the rib 115. The right-hand member 46 is automatically retained in the lowered position by the stop peg 54 which abuts an extension **114*a* of a trunnion 114. Access to the stop peg 54 can be obtained through a hole 114*b* in the member 38 to enable the stop peg to be removed and allow the article carrying member 46 to be completely removed from the main support member 38.**

Figure 21:
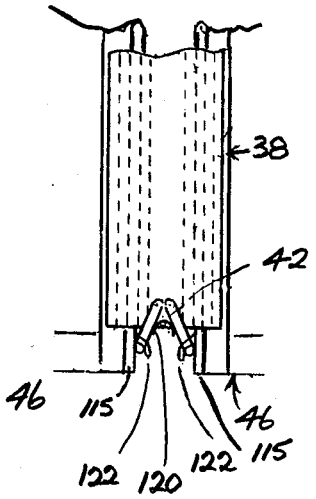
FIG. 21 is a view similar to FIG. 18 but showing another modified construction.

FIG. 21 illustrates a somewhat similar apparatus to that illustrated in FIGS. 18 to 20 with the exception that the two substantially C-shaped main support members are combined into a single main support member 38 of substantially 'H' cross-sectional shape to afford the two T-shaped grooves and the two pivoted catch means 42 are pivoted to the main support member 38 at closely adjacent positions and a biasing spring 120 is mounted on the main support member 38 and bears against the catches to urge them apart into operative positions in which they can engage tongues 122 provided on the T-shaped ribs 115 of the article carrying members 46 to retain said article carrying members in their raised positions as shown in FIG. 21. In order to lower an article carrying member 46, the appropriate catch 42 is manually disengaged from the tongue 122 to enable the article carrying member to move downwardly into its lowered position in which it is retained by the appropriate catch 42 being spring-biased into a stop recess 118 as previously described with reference to FIG. 18.

Figure 22:
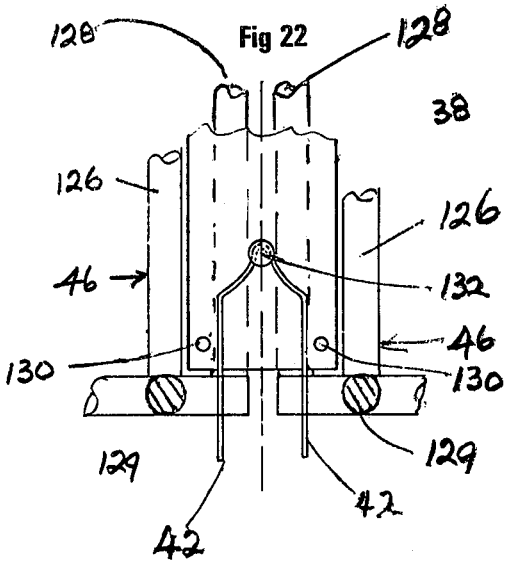
FIG. 22 is a fragmentary view of another modified construction including spring catch means.
Figure 23:
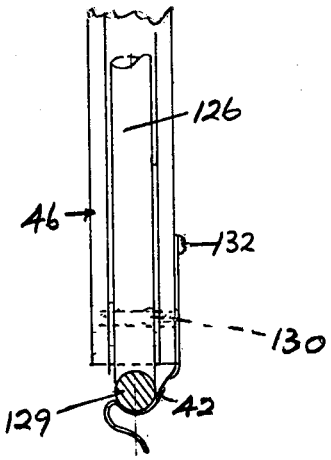
FIG. 23 is a side view of FIG. 22.
Figure 24:
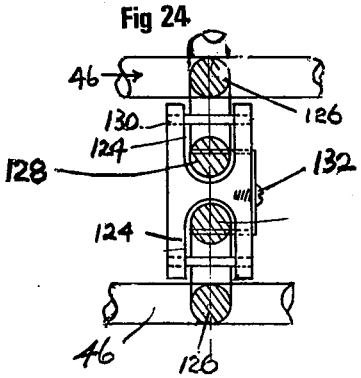
FIG. 24 is a plan view of FIG. 23.

Referring to FIGS. 22 to 24, a main support member 38 is of substantially H cross-sectional shape as shown in FIG. 24 to afford two opposite vertical grooves 124. Each of two article carrying members 46 includes two vertical transversely spaced apart rods 126 and 128 which are rigidly connected together by an upper horizontal rail (not shown) and a lower horizontal rail 129 and the vertical rod 128 is slidably engaged in a vertical groove 124 and is retained against disengagement in a lowered position of the article carrying member 46 by a retaining pin 130 which is supported in the main support member 38 and extends across the groove 124 adjacent a mouth thereof and said retaining pin 130 forms a stop means to co-operate with the upper horizontal rail of the article carrying member to retain said article carrying member in its lowered position but said retaining pin 130 may be removable from the main support member 38 to permit detachment of the article carrying member 46 from said main support member 38.

Releasable catch means 42 are provided and are made of spring wire secured by a screw 132 to the main support member 38 and said spring catch comprises two depending arms as shown in FIG. 22 and each arm is so shaped that when the article carrying member 46 is raised, the lower horizontal rail 129 thereof engages and displaces the spring catch which afterwards then returns to a position beneath the rail 129 as shown in FIG. 23 to retain said article carrying member in its raised position and said spring catch can thereafter be manually displaced into a position away from the article carrying member 46 to allow said member to move downwardly into the lowered position in which it is retained by the retaining pin 130 as previously described.

Figure 25:
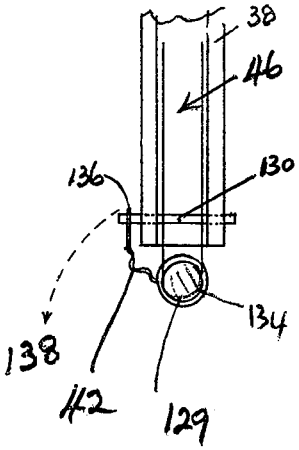
FIG. 25 is a fragmentary side view of another modified construction including a manually engageable catch means, and, FIG. 26 is a front view of FIG. 25.
Figure 26:
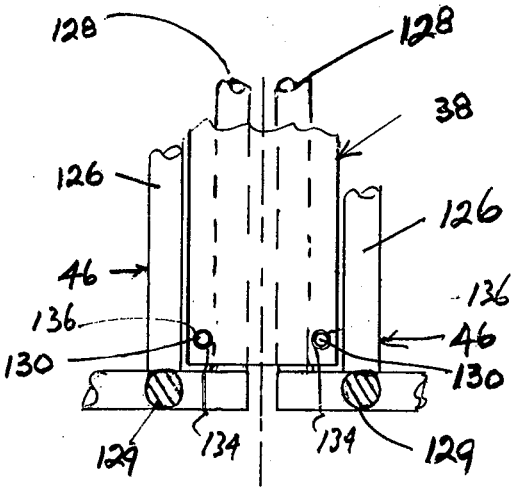

The construction illustrated in FIGS. 25 and 26 is similar to the construction in FIGS. 22 to 24 with the exception that a releasable catch means 42 is formed at one end with a ring 134 which loosely encircles a lower horizontal rail 129 of an article carrying member 46 and at its other end is formed with an eye 136 which can be engaged with and disengaged from an extension of a retaining pin 130. In FIGS. 25 and 26, the article carrying member 46 is shown in its raised position in which it is retained by the engagement of the catch means 42 with the pin 130 and in order to lower the article carrying means 46, the catch means 42 is manually swung about the rail 129 in an anti-clockwise direction as indicated by the arrow 138 so that the ring 136 is disengaged from the pin 130 and the article carrying means 46 can be moved downwardly into its lowered position in which it is retained by the retaining pin 130. The article carrying means 46 can subsequently be lifted into its raised position as shown in FIG. 25 in which it is retained by the operator manually swinging the catch 42 in a clockwise position about the rail 129 so that the ring 136 is again engaged with the pin 130. It should be appreciated that in FIGS. 25 and 26 the releasable catch means 42 is manually movable into co-operative engagement with the retaining pin 130 when the article carrying member 46 is in its raised position whereas in the other construction the releasable catch means is biased so that when the article carrying member is lifted into its raised position, it is automatically retained in this raised position.

I claim:

1. Overhead storage apparatus comprising a main support member which has an attachment means at an upper end thereof whereby said member can be attached to an overhead stationary support; a tubular article carrying member which is mounted on the main support member so as to be slidable upwardly and downwardly therealong and is engaged with the main support member so that it is not turnable therearound, the lower end portion of the article carrying member being formed with a gap and having at the upper end of said gap a downwardly facing transverse abutment face; releasable catch means comprising an upwardly facing transverse abutment face which is provided on an upwardly bent lower end portion of the main support member and is resiliently biased to an operative position in which it is positively engaged beneath said abutment face of the article carrying member when the article carrying member is lifted into a raised position relative to the main support member to retain the article carrying member in said raised position, the main support member being resiliently flexible and bowed so that it bears against the internal surface of the article carrying member at the side of the latter opposite that side at which the abutment faces are disposed and said faces are thereby biased into mutual engagement by the inherent resilience of the main support member, the upwardly bent lower end portion of the main support member being disposed in said gap in the lower end of the article carrying member when the catch means is engaged and said abutment faces being manually transversely relatively movable out of mutual engagement against said resilient bias to release the catch means and allow the article carrying member to move downwardly relative to the main support member into a lowered position; and a stop arranged inside the tubular article carrying member so as to be engaged by said abutment face of the main support member when the article carrying member is moved to its lowered position thereby to retain the article carrying member in said lowered position.

2. Overhead storage apparatus comprising a main support member having an attachment means at an upper end thereof whereby said member can be attached to an overhead stationary support, a plurality of article carrying members mounted in end-to-end relation on the main support member so as to be slidable upwardly and downwardly along said main support member and each having a lower abutment face, and releasable catch means comprising a transverse abutment lug at the lower end of the main support member which is biased into engagement with the lower abutment face of the lowermost article carrying member when the lowermost article carrying member is lifted into a raised position to support said article carrying member in said raised position, said abutment lug and abutment face being manually transversely relatively movable at a position adjacent the lower ends of said members, out of mutual engagement against said bias to release the catch means and permit downward sliding movement of the lowermost article carrying member along the main support member into a lowered position, the lower and upper ends of adjacent upper and lower article carrying members respectively being positively transversely displaced relatively to one another by a spigot which is provided on one of the adjacent ends of said adjacent article carrying members and which abuts an interior side face of the adjacent article carrying member opposite to the face thereof toward which said abutment lug extends whereby on removal of the lower one of said adjacent article carrying members from the main support member said spigot positively urges the lower abutment face of the upper one of said adjacent article carrying members into engagement with the abutment lug.

3. Overhead storage apparatus according to claim 2 wherein the other of the adjacent ends of said adjacent article carrying members is formed with a socket which can be engaged by the spigot on said one of the adjacent ends of said adjacent article carrying members to enable the adjacent article carrying members also to be disposed in aligned end-to-end relation.

4. Overhead storage apparatus according to claim 2 wherein resilient biasing means are provided between the article carrying member and the main support member for resiliently biasing the article carrying member relative to the main support member thereby resiliently to bias said abutment lug into positive engagement with the lower abutment face of the lowermost article carrying member to support said article carrying member in its raised position, said abutment lug and abutment face being manually transversely relatively movable out of mutual engagement against the action of said resilient biasing means to release the catch means and permit downward sliding movement of the article carrying member along the main support member.

5. Overhead storage apparatus comprising a main support member which has an attachment means at an upper end thereof whereby said member can be attached to an overhead stationary support; a tubular article carrying member which is mounted on the main support member so as to be slidable upwardly and downwardly therealong and has a downwardly facing transverse abutment face; and releasable catch means comprising an upwardly facing transverse abutment face which is provided on a lug formed integrally with the main support member adjacent the lower end thereof and is resiliently biased to an operative position in which it is positively engaged beneath said abutment face of the article carrying member when the article carrying member is lifted into a raised position relative to the main support member to retain the article carrying member in said raised position, the main support member being resiliently flexible and bowed so that it bears against the internal surface of the tubular article carrying member at the side of the latter opposite to that side at which the said abutment faces are disposed and said faces are thereby biased into mutual engagement by the inherent resilience of the main support member, said abutment faces being manually transversely relative movable out of mutual engagement against said resilient bias to release the catch means and allow the article carrying member to move downwardly relative to the main support member into a lowered position.

* * * * *

UNITED STATES PATENT OFFICE

CERTIFICATE OF CORRECTION

PATENT NO. : 3,961,711

DATED : June 8, 1976

INVENTOR(S) : Arthur Thomas Perks

It is certified that error appears in the above-identified patent and that said Letters Patent are hereby corrected as shown below:

Claims priority application Great Britain 6662/72 filed February 12, 1972.

Signed and Sealed this

Thirty-first Day of August 1976

[SEAL]

*Attest:*

RUTH C. MASON
*Attesting Officer*

C. MARSHALL DANN
*Commissioner of Patents and Trademarks*